US008978243B2

(12) United States Patent
Mei et al.

(10) Patent No.: US 8,978,243 B2
(45) Date of Patent: Mar. 17, 2015

(54) METHODS AND SYSTEMS FOR OIL FREE LOW VOLTAGE CONDUITS

(75) Inventors: Luciano Mei, Sesto Fiorentino (IT); Fabrizio Franci, Florence (IT); Dino Bianchi, Florence (IT)

(73) Assignee: Nuovo Pignone S.P.A., Florence (IT)

( * ) Notice: Subject to any disclaimer, the term of this patent is extended or adjusted under 35 U.S.C. 154(b) by 220 days.

(21) Appl. No.: 13/480,563

(22) Filed: May 25, 2012

(65) Prior Publication Data

US 2012/0299412 A1 Nov. 29, 2012

(30) Foreign Application Priority Data

May 25, 2011 (IT) ..... CO11A0020

(51) Int. Cl.

| | |
|---|---|
| ***H01R 4/02*** | (2006.01) |
| ***F04D 25/06*** | (2006.01) |
| ***F04D 13/10*** | (2006.01) |
| ***F04D 29/058*** | (2006.01) |

(52) U.S. Cl.

CPC ..... *F04D 25/0693* (2013.01); *F04D 13/10* (2013.01); *F04D 29/058* (2013.01); *H01R 4/023* (2013.01); *H01R 4/029* (2013.01)

USPC ..... 29/825; 310/71

(58) Field of Classification Search

None

See application file for complete search history.

(56) References Cited

U.S. PATENT DOCUMENTS

| | | | | |
|---|---|---|---|---|
| 2,808,492 | A | 10/1957 | Yohe | |
| 4,679,317 | A | 7/1987 | Bailleul | |
| 4,689,443 | A | 8/1987 | Bailleul | |
| 5,214,243 | A | 5/1993 | Johnson | |
| 5,359,491 | A | 10/1994 | Coville | |
| 5,890,913 | A * | 4/1999 | Kyllonen | 439/63 |
| 5,892,365 | A | 4/1999 | Bailleul | |
| 6,798,107 | B2 | 9/2004 | Leijon | |
| 6,837,741 | B2 | 1/2005 | Kuwahara | |
| 2004/0179961 | A1 | 9/2004 | Pugnet | |
| 2007/0132327 | A1 | 6/2007 | Brunet | |

FOREIGN PATENT DOCUMENTS

| | | | |
|---|---|---|---|
| CN | 1220042 | A | 6/1999 |
| CN | 1538562 | A | 10/2004 |
| CN | 101326378 | A | 12/2008 |

(Continued)

OTHER PUBLICATIONS

Search Report and Written Opinion for corresponding Italian Application No. CO2011A000020, dated Dec. 23, 2011.

(Continued)

*Primary Examiner* — Tran Nguyen

(74) *Attorney, Agent, or Firm* — GE Global Patent Operation

(57) ABSTRACT

A turbomachine is provided. The turbomachine comprises a compressor, at least two magnetic bearings provided at opposite ends of a compressor shaft, a motor having a motor shaft, a first electrical cable having a first end, a second end, an internal core section and an outer sheath section with the internal core section and the outer sheath section extending from the first end to the second end, a first connector configured to connect the first end to the first magnetic bearing, wherein the first connector is welded or brazed to the first end to both the internal core section and the outer sheath section, and a second connector configured to connect the second end to the first external connection, wherein the second connector is welded or brazed to the second end to both the internal core section and the outer sheath section.

3 Claims, 9 Drawing Sheets

(56) References Cited

FOREIGN PATENT DOCUMENTS

| | | | |
|---|---|---|---|
| CN | 101707296 | A | 5/2010 |
| DE | 8716166 | U1 | 1/1988 |
| DE | 8716167 | U1 | 1/1988 |
| DE | 3842294 | A1 | 6/1990 |
| DE | 20301679 | U1 | 4/2003 |
| DE | 202004015135 | U1 | 12/2004 |
| DE | 10330862 | A1 | 1/2005 |
| EP | 0386333 | A1 | 9/1990 |
| EP | 2003342 | A2 | 12/2008 |
| EP | 2219267 | A1 | 8/2010 |
| FR | 2590980 | A1 | 6/1987 |
| GB | 2057781 | A | 4/1981 |
| GB | 2100159 | A | 12/1982 |
| WO | 2007110275 | A1 | 10/2007 |

OTHER PUBLICATIONS

Unofficial English Translation of Chinese Office Action issued in connection with corresponding CN Application No. 201210165695.X on Dec. 3, 2014.

* cited by examiner

METHODS AND SYSTEMS FOR OIL FREE LOW VOLTAGE CONDUITS

BACKGROUND OF THE INVENTION

1. Field of the Invention

Embodiments of the present invention relate generally to methods and systems and, more particularly, to mechanisms and techniques for electrically connecting various internal parts of a turbomachinery to an external connection.

2. Description of the Related Art

During the past years, the importance of turbomachines in various industries has increased. A turbomachine can be a compressor, expander, turbine, pump, etc. or a combination thereof. Turbomachines are used in engines, turbines, power generation, cryogenic applications, oil and gas, petrochemical applications, etc. Thus, there is a need for improving the efficiency and reliability of turbomachines.

A known turbomachine often used in industry includes a compressor driven by an electrical motor. Such a turbomachine may be employed, for example, for recovering methane, natural gas, and/or liquefied natural gas (LNG). The recovery of such gasses would reduce emissions and reduce flare operations during the loading of LNG onto ships. Other uses of this kind of turbomachine are known in the art and not discussed here.

An example of such a turbomachine is shown in FIG. 1. The turbomachine 2 includes an electrical motor 4 connected to a compressor 6. The connection between the two machine shafts can be achieved by a mechanical joint 8. The motor's external casing 10 may be attached to the compressor's external casing 12 by, for example, bolts 14. The compressor 6 may include one or more impellers 16 attached to a compressor shaft 18. The compressor shaft 18 is configured to rotate around a longitudinal axis X. The rotation of the compressor shaft 18 is enhanced by using magnetic bearings 20 and 22 at both ends of the compressor shaft 18.

However, the magnetic bearings 20 and 22 require a supply of electrical power in order to function. The electrical power is supplied to the magnetic bearings 20 and 22 via cables 24 and 26. Cable 24 connects to the magnetic bearing 20 while cable 26 connects to the magnetic bearing 22. Cable 24 is provided with a head 28 that is configured to mate with a corresponding head 30 of an external electrical cable 32. Cable 26 connects in a similar way to an external cable 34. Cables 24 and 26 are exposed to the media that is processed by the compressor. This media may be corrosive and is likely to have a high pressure and temperature. Thus, specific precautions need to be taken for protecting the cables. Cables 24 and 26 may be attached to an internal wall of the compressor casing 12. The same is true for the motor 4, in which cables 36 and 38 connect magnetic bearings 40 of the motor 4 to an outside power source.

The cables 24 and 26 are representative of conventional low voltage conduits for delivering electricity to the magnetic bearings 20 and 22. These conventional conduits are typically constructed using metallic conduits which contain electrical cables. These conduits are then filled with oil to provide both electrical insulation and to provide additional resistance to external pressures which often exist in the various working environments for the turbomachine 2. The electrical cables 24 and 26 can reside in metallic conduits, which can be flexible or rigid. An example, as shown in FIG. 2, of a flexible metallic conduit is a corrugated pipe 42. The corrugated pipe has a small thickness of sheet metal, which may be a stainless steel. Low voltage electrical connections are typically attached to each end of the corrugated pipe by welding. The corrugated pipe is then typically surrounded by a bridle 44, an example of which is shown in FIG. 3, of metal that assists in protecting the corrugated pipe from damage during assembly and operation. An example of a conventional rigid conduit is a rigid pipe which contains the electrical cables and has an electrical connector on each end of the pipe. These conventional electrical cables can generally operate in conditions of up to 125° C. and 140 bar. These conventional conduits have various considerations for use as will now be described.

Oil filled corrugated pipes 42 typically need to support external pressure applied upon them while maintaining some flexibility. This tradeoff results in thin walls to reduce stress when bending, while attempting to provide support against externally applied pressure. Handling and fabrication of the oil filled corrugated pipes is also challenging due to the small wall thickness of these corrugated pipes as well as the need to be correctly filled so as to remove the presence of gas which may generate conduit restriction when under an external gas pressure. Also the thermal gradient needs to be considered since the oil expansion from heating can also generate undesirable mechanical stress on the corrugated pipe. Additionally, for flexible pipes, which contain electrical cables, the environment within the turbomachine 2, for example, an acid or sour gas presence, may also cause failure (or premature replacement requirements) for the thin walled, flexible, corrugated pipes 42.

For rigid pipes, routing and assembly within the turbomachine 2 is generally not optimal due to the lack of flexibility of the pipes. Accordingly, it would be desirable to have other methods and systems for routing electrical cables within a turbomachine.

BRIEF SUMMARY OF THE INVENTION

According to an exemplary embodiment, a turbomachine is provided. The turbomachine includes: a compressor having a compressor shaft configured to rotate; at least two magnetic bearings provided at opposite ends of the compressor shaft and configured to support the compressor shaft; a motor having a motor shaft configured to be connected to the compressor shaft, and a first electrical cable configured to connect a first magnetic bearing to a first external connection, wherein the first electrical cable has a first end, a second end, an internal core section and an outer sheath section with the internal core section and the outer sheath section extending from the first end to the second end. Additionally, there is a first connector configured to connect the first end of the first electrical cable to the first magnetic bearing, wherein the first connector is welded or brazed to the first end of the first electrical cable to both the internal core section and the outer sheath section; and a second connector configured to connect the second end of the first electrical cable to the first external connection, wherein the second connector is welded or brazed to the second end of the second electrical cable to both the internal core section and the outer sheath section.

According to another exemplary embodiment, a method for electrically connecting magnetic bearings in a turbomachine to external connectors is provided. The method includes: welding or brazing a first connector to a first end of a first electrical cable, wherein the first connector is welded or brazed to both an internal core section and an outer sheath section of the first end of the first electrical cable; and welding or brazing a second connector to a second end of the first electrical cable, wherein the second connector is welded or brazed to both the internal core section and the outer sheath section of the second end of the first electrical cable.

According to another embodiment, a turbomachine is provided. The turbomachine comprises: a rotor with a rotor shaft configured to rotate; at least a first magnetic bearing and a second magnetic bearing arranged and configured to support the rotor shaft. A first electrical cable is configured to connect the first magnetic bearing to a first external connection, wherein the first electrical cable has a first end, a second end, an internal core section and an outer sheath section with the internal core section and the outer sheath section extending from the first end to the second end. A first connector is configured to connect the first end of the first electrical cable to the first magnetic bearing, wherein the first connector is welded or brazed to the first end of the first electrical cable to both the internal core section and the outer sheath section. A second connector is configured to connect the second end of the first electrical cable to the first external connection, wherein the second connector is welded or brazed to the second end of the second electrical cable to both the internal core section and the outer sheath section.

BRIEF DESCRIPTION OF THE DRAWINGS

The accompanying drawings illustrate exemplary embodiments, wherein.

DETAILED DESCRIPTION OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to exemplary embodiments, oil free electrical conduits can provide low voltage to magnetic bearings in turbomachines, for example, compressor, expander, turbine, pump, etc. or a combination of them, in ways which avoid or minimize some or all of the issues described for conventional electrical conduits in the Background section. Additionally, some exemplary embodiments, can realize cost savings over conventional conduits by, for example, providing a longer working life at higher pressures and temperatures for the electrical conduits.

Figure 4:
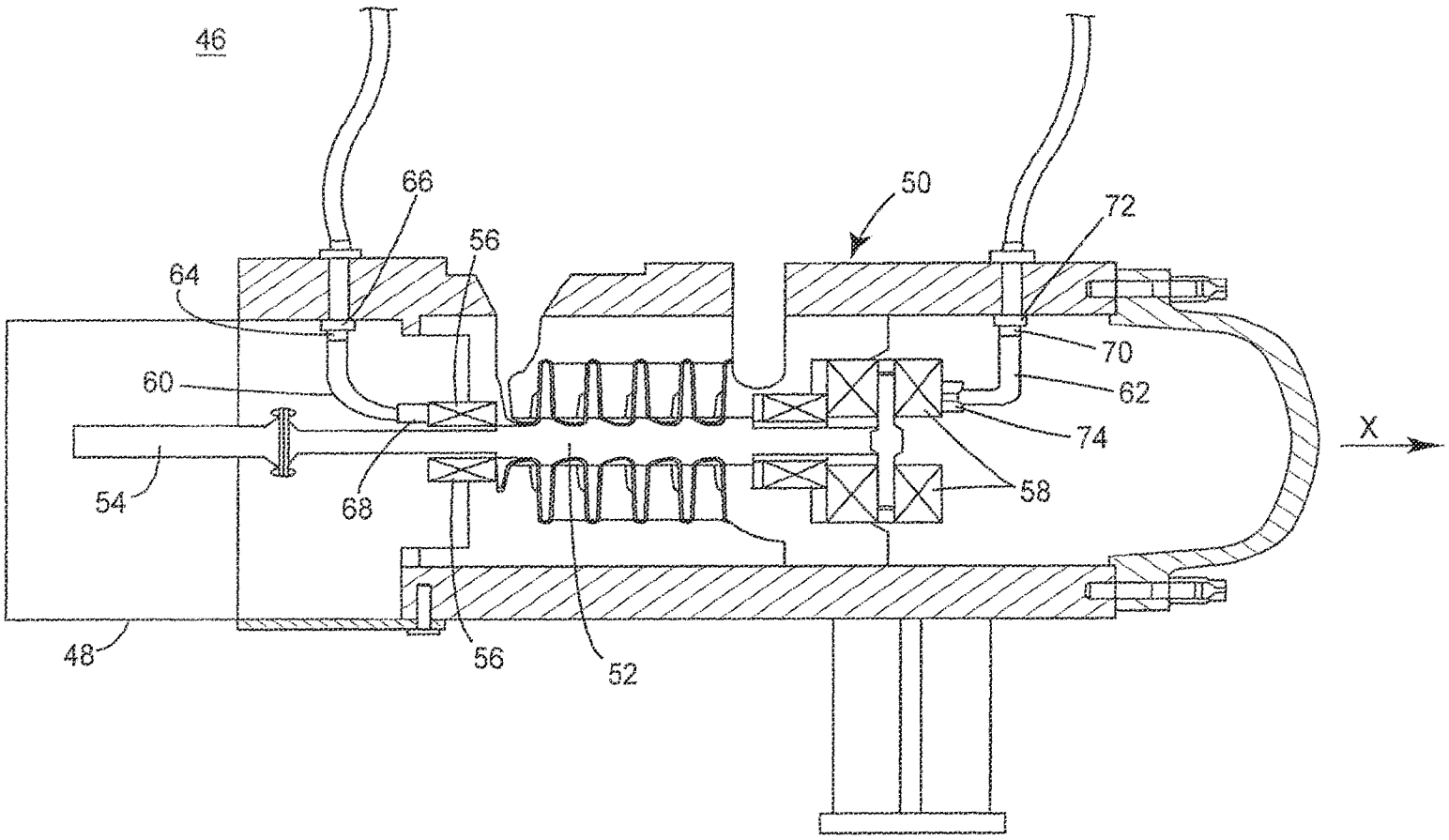
FIG. 4 illustrates a turbomachine according to an exemplary embodiment.

Prior to describing various exemplary embodiments associated with the oil free (or fluid free), low voltage conduits, an example of such an exemplary turbomachine 46 as shown in FIG. 4 is now described. This exemplary turbomachine 46 can have similarities to the turbomachine 2 shown in FIG. 1, except that, at a minimum, the conduits for providing the voltage to the magnetic bearings are different (as well as other inter-related parts as are described below) as compared to the conduits used in a conventional turbomachine 2. According to an exemplary embodiment, the turbomachine 46 includes an electrical motor 48 connected to a compressor 50. A compressor shaft 52 and a motor shaft 54 are connected and configured to rotate around a longitudinal axis X. The rotation of the compressor shaft 52 is enhanced by using magnetic bearings 56 and 58 at both ends of the compressor shaft 52.

According to exemplary embodiments, electrical power is supplied to the magnetic bearings 56 and 58 via electrical cables 60 and 62. Electrical cable 60 connects to the magnetic bearing 56 while electrical cable 62 connects to the magnetic bearing 58. Electrical cable 60 can be provided with a connector 64 on one end to mate with an external connection 66 and another connector 68 to mate with the magnetic bearing 56. Electrical cable 62 can be provided with a connector 70 on one end to mate with an external connection 72 and another connector 74 to mate with the magnetic bearing 58. These electric cables 60 and 62 are exposed to the media that is processed by the compressor 50, which may be corrosive, under a high pressure and/or at an elevated temperature, for example, 500° C. and 220 bar (which may occur on a suction side of the turbomachine 46) or up to 700 bar (which may occur on a discharge side of a turbomachine 46). However, according to alternative exemplary embodiments, the electrical cables 60 and 62, magnetic bearings 56 and 58, connectors 64 and 68, and methods of connection described herein could be used with other temperature and pressure combinations, that is, it is expected that as higher pressures and temperatures are used in turbomachinery (temperatures over 500° C. and pressures over 700 bar) exemplary embodiments described herein can be generally scaled as needed for use in those environments.

According to alternative exemplary embodiments, various modifications to the turbomachine 46 can also support exemplary embodiments which are described in more detail below. Modifications to turbomachine 46 can include having a compressor and a motor having a single, one-piece shaft (or rigidly connected shafts). For this case, at the interface between the compressor and the motor, a shared bearing can be used, leading to a configuration with a total of three magnetic bearings for this turbomachine. Alternatively, as more elements are added to a turbomachine which use one or more shafts, the quantity of magnetic bearings used can change and be significantly increased, for example, two magnetic bearings per shaft per component of the turbomachine which uses a shaft in an environment that includes the process fluid. It is to be understood that the quantity of magnetic bearings used herein is not to be considered limiting. Additionally, turbomachines can include more or fewer parts and components. Alternatively, a turbomachine can be described more generically which can still make use of exemplary embodiments described herein. For example, a turbomachine can alternatively be described to include a rotor with a rotor shaft which rotates and includes magnetic bearings, electrical cables and connectors as described in exemplary embodiments described herein.

Figure 1:
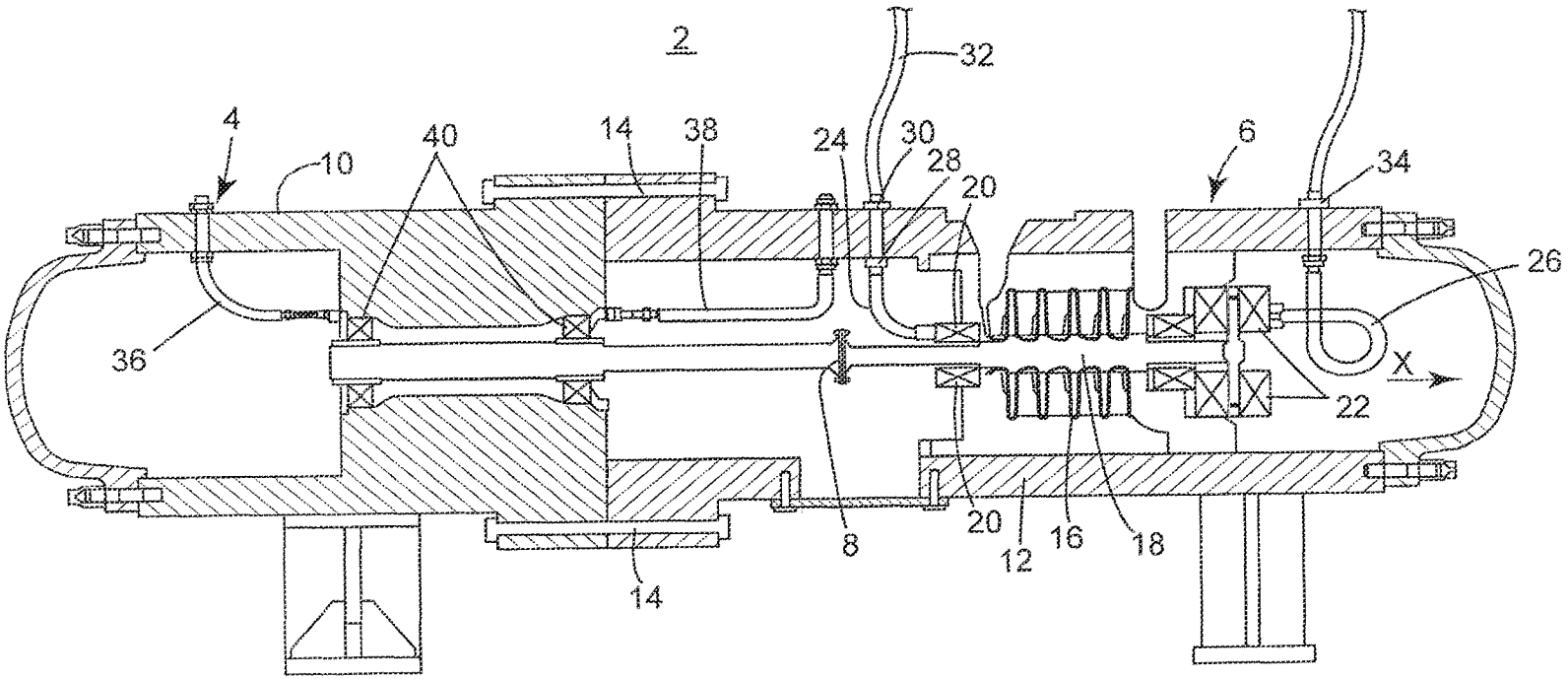
Figure 1 (Background Art)
FIG. 1 depicts a turbomachine.
Figure 2:
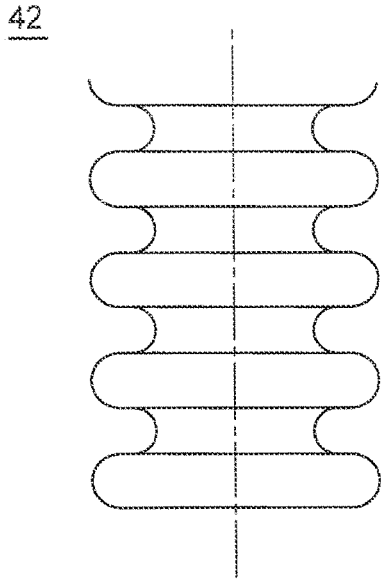
Figure 2 (Background Art)
FIG. 2 illustrates a corrugated pipe.
Figure 3:
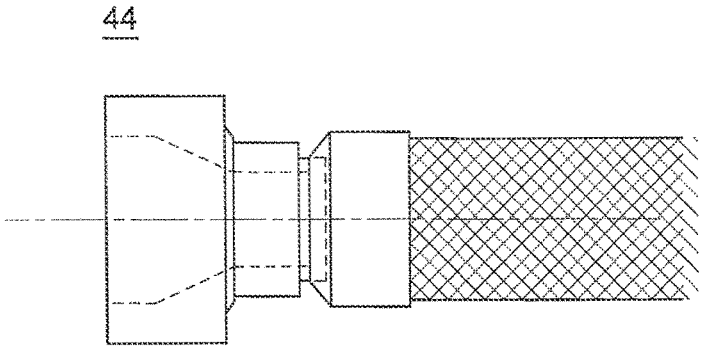
Figure 3 (Background Art)
FIG. 3 shows a bridle for a corrugated pipe.
Figure 5:
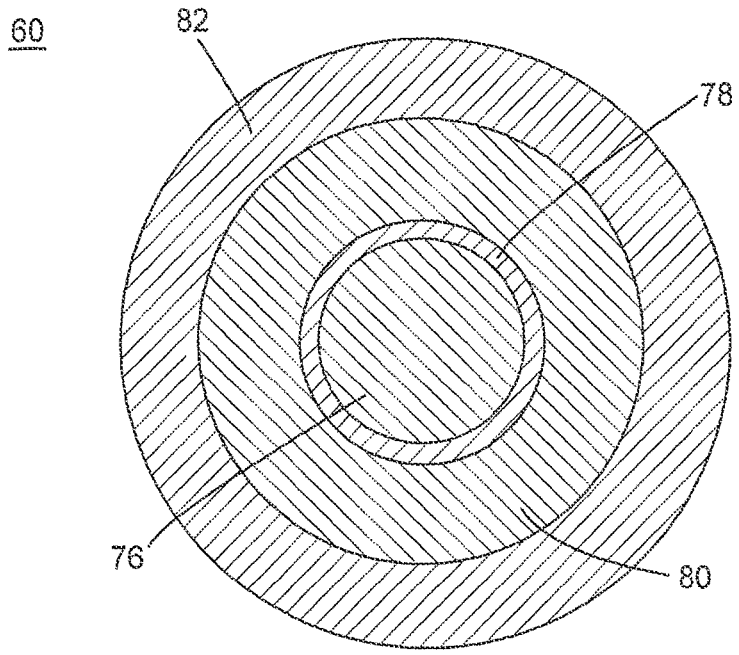
FIG. 5 shows a cross section of an electrical cable according to an exemplary embodiment.

According to an exemplary embodiment, electrical cables 60 and 62 can be flexible while having better chemical properties for withstanding corrosive properties as well as having better mechanical properties for operating at elevated temperatures and pressures that can exist within turbomachine 46 as compared to, for example, conventional cables 24 and 26 within a conventional turbomachine 2 as shown in FIG. 1. An example of such an exemplary electrical cable 60 (or 62) is shown in FIG. 5. According to an exemplary embodiment, electrical cable 60 can include a conductive core 76, for example, copper, a copper alloy or other acceptable conductor for operating in this environment, with a cladding 78, for example, an austenitic stainless steel cladding. The cladding 78 is surrounded by an insulator 80, for example, a magnesium or aluminum oxide powder, which is then surrounded by an outer sheath 82, for example, IN625 or an austenitic stainless steel. The insulator 80 prevents electrical leakage from the conductive core 76 to the outer sheath 82 while also providing support for use under high pressures allowing for little or no deformation of the electric cable 60.

According to exemplary embodiments, electrical cables 60 and 62 do not require internal oil fill (or other fluid fill). The diameter of the electrical cables 60 and 62 may be approximately 6 mm, with a length varying depending upon the size of the turbomachine 46 and how the electrical cables are routed within the turbomachine 46. Also it is possible to form out the electrical cables 60 and 62 before assembly by, for example, using tooling to fit and make the desired routing within the turbomachine 46. Additionally, electrical cables 60 and 62 may each represent a plurality of electrical cables for delivering the low voltage to the magnetic bearings 56 and 58.

Figure 6:
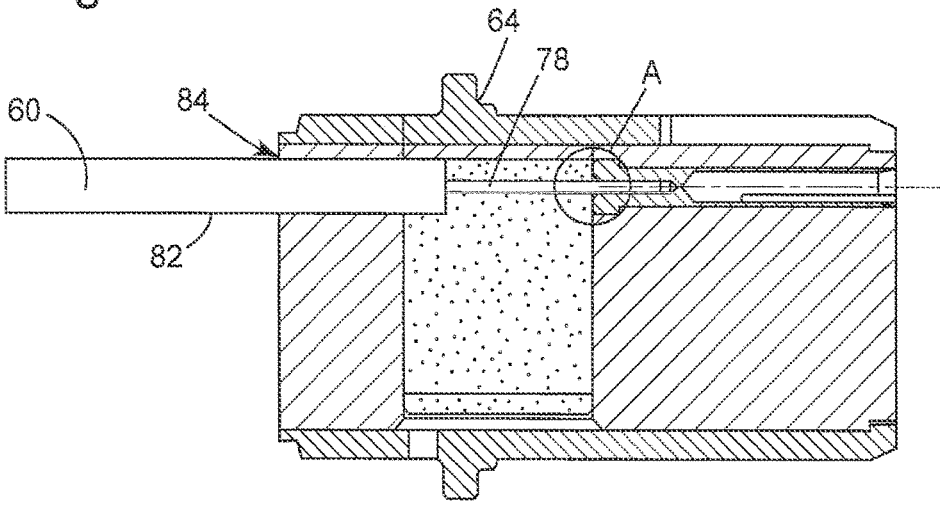
FIGS. 6 and 7 show weld positions for attaching a connector to an electrical cable according to an exemplary embodiment.

According to exemplary embodiments, connectors 64, 68, 70 and 74 can be welded to each end of the electrical cables 60 and 62. An example of a connector 64, 68, 70 and 74 that can be welded or brazed to an end of an electrical cable 60 or 62 is now described with respect to FIGS. 6 and 7. FIG. 6 shows the electrical cable 60 and the connector 64. Reference point 84 shows a position where the outer sheath 82 can be fully circumferential welded or brazed to the connector 64. Area A, which shows an expanded view of a second weld location, is shown in an expanded view in FIG. 7.

Figure 7:
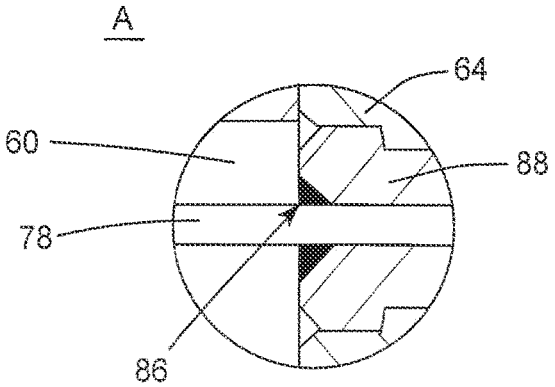

According to exemplary embodiments, FIG. 7 shows where the cladding 78 can be welded or brazed to a connector pin 88 of the connector 64 at reference point 86. For both of the attachments, if brazing is used, a brazing powder should be selected that avoids or minimizes any negative interactions, for example, undesirable thermal expansion or damage to the insulator 80, between the electrical cable 60 and the connector 64, as well as, between the various sections of the electrical cable 60. Similar methods for attaching a connector 68, 70 and 74 can be used for the other end of electrical cable 60, both ends of electrical cable 62 and other electrical cables used.

Figure 8:
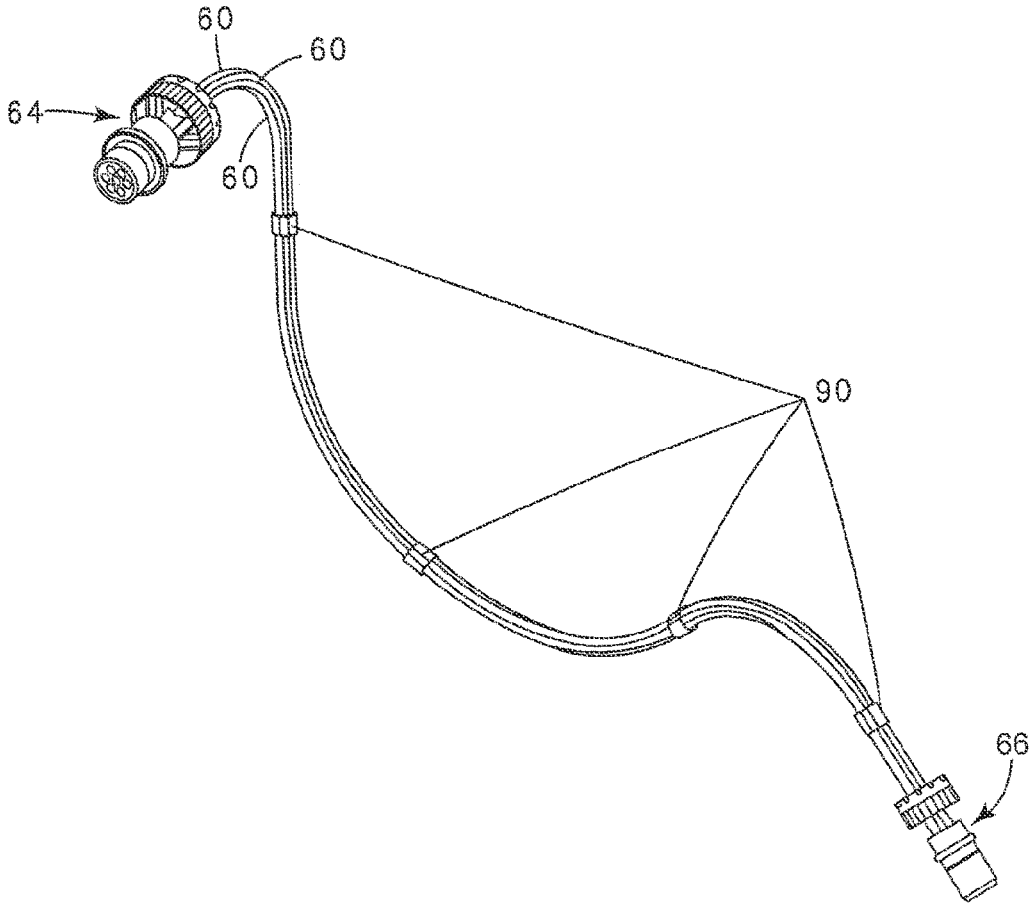
FIG. 8 illustrates an electrical cable with belts according to an exemplary embodiment.
Figure 9:
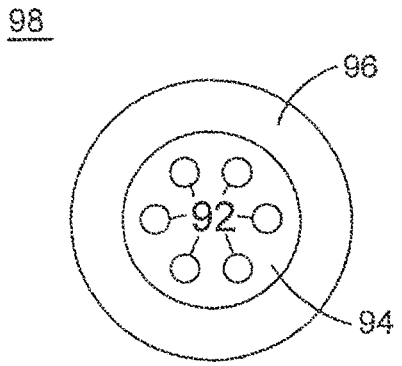
FIG. 9 shows multiple conductive cores in an electrical cable according to an exemplary embodiment.

According to exemplary embodiments, a plurality of electrical cables 60 with a similar shape can be used to supply a low voltage from the external connection 66 to the magnetic bearing 56 as shown in FIG. 8. Also, each connector 64 and 66 can be attached to multiple electric cables 60. As shown in FIG. 8, one or more belts 90 can be used to keep the electrical cables 60 generally together and to provide some dampening for them from the vibrations that can be generated when the turbomachine 46 is in operation. The electrical cables 60 can also be supported by and/or attached to the casing of the turbomachine 46 to further reduce the possibility of damage from vibrations. According to an alternative exemplary embodiment, a plurality of conductive cores can reside within a single electrical cable as shown in FIG. 9. More specifically, FIG. 9 shows a single electric cable 98 with multiple conductive cores 92, an insulation section 94 and an outer sheath 96. The materials used for these sections are similar to those described above for a single conductive core in a single electrical cable. Also, each conductive core 92 can be surrounded by a cladding.

Figure 10:
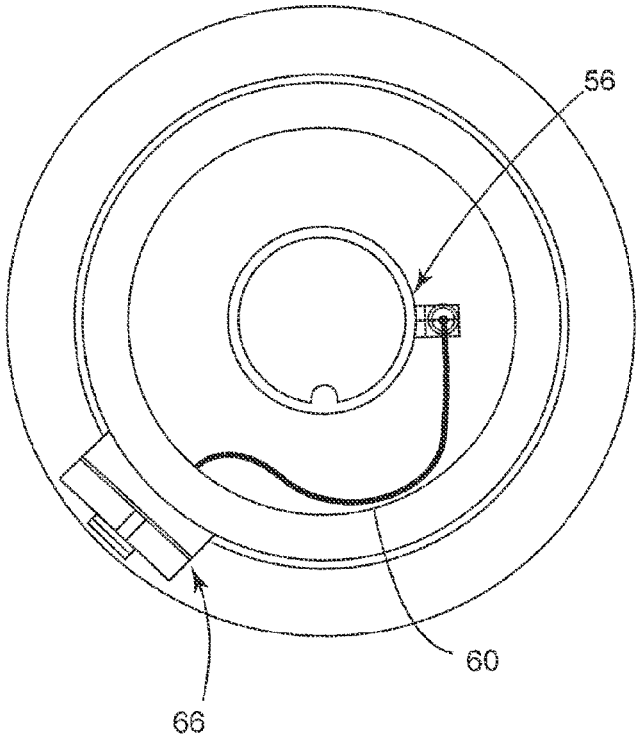
FIG. 10 shows a possible routing for an electrical cable according to an exemplary embodiment.

According to an exemplary embodiment, FIG. 10 shows a routing of the electrical cable 60 from the magnetic bearing 56 to the external connection 66. A length for this routing can be, for example, one meter. However, other routings and lengths of the electrical cable 60 within the turbomachine 46 can be used as desired. Additionally, while exemplary embodiments described herein have generally described electrical cables providing low voltage to magnetic bearings in a compressor, which can be a part of the turbomachine, these examples are not to be considered limiting to only the compressor. Instead, these exemplary embodiments can also be applied to electric cables providing electricity to magnetic bearings in other components of turbomachines as desired.

Figure 11:
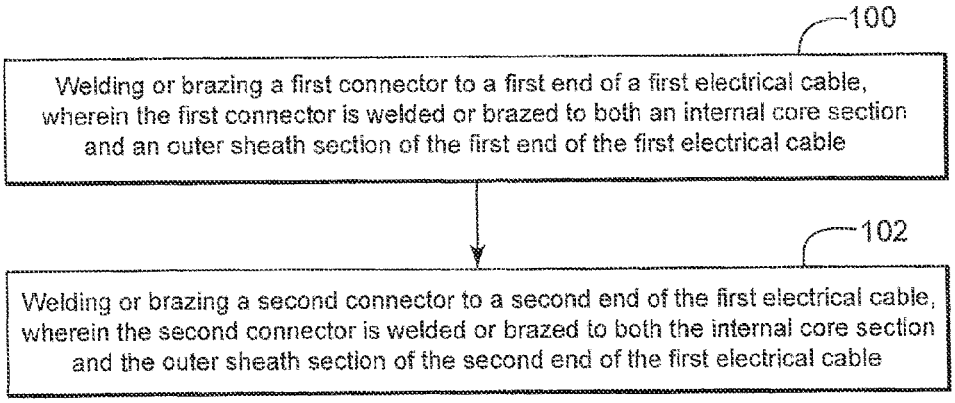
FIG. 11 shows a flowchart of a method according to exemplary embodiments.

Utilizing the above-described exemplary systems according to exemplary embodiments, a method for electrically connecting magnetic bearings in a turbomachine to external connectors is shown in the flowchart of FIG. 11. The method for electrically connecting magnetic bearings in a turbomachine to external connectors includes: a step 100 of welding or brazing a first connector to a first end of a first electrical cable, wherein the first connector is welded or brazed to both an internal core section and an outer sheath section of the first end of the first electrical cable and a step 102 of welding or brazing a second connector to a second end of the first electrical cable, wherein the second connector is welded or brazed to both the internal core section and the outer sheath section of the second end of the first electrical cable. According to an alternative exemplary embodiment, the connectors 64, 68, 70 and 72 may be welded to the cladding 78 of the internal core section 76.

According to at least one of the exemplary embodiments described herein, various advantages can be provided in the environment of turbomachines. For example, according to exemplary embodiments flexible electrical cables described herein can have better chemical properties for withstanding corrosive properties associated with various process fluids, as well as having better mechanical properties for operating at elevated temperatures and pressures then currently used electrical cables in conventional turbomachines. For another example, exemplary embodiments described herein can be used for other magnetic bearings which operate in a process fluid. The exemplary electrical cable 60 can have a smaller size and thickness with acceptable flexibility as compared with various conventional rigid pipe solutions. Additionally, significant cost reductions can be realized by implementing exemplary embodiments described herein, for example, the electrical cable 60 could cost as much as twenty times less than the cost of similarly used conventional electrical cables in a turbomachine.

The above-described exemplary embodiments are intended to be illustrative in all respects, rather than restrictive, of the present invention. Thus, embodiments of the present invention is capable of many variations in detailed implementation that can be derived from the description contained herein by a person skilled in the art. For examples, other types of connectors (other than connectors 64, 68, 70 and 74) could be used for connecting the electrical cables 60 and 62 to the magnetic bearings 56 and 58 as well as the external connections 66 and 72 while maintaining all of the desired electrical, mechanical and chemical properties desired for use within the turbomachine 46. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A method for electrically connecting a magnetic bearing to an external connector, using a first electrical cable having a first end and a second end, the electrical cable being configured to connect to the external connector to the bearing, the method comprising:

welding or brazing a first connector to the first end of the first electrical cable, wherein the first connector is welded or brazed to an internal core section by welding or brazing a cladding layer to an internal connector pin, and to an outer sheath section of the first end of the first electrical cable; and welding or brazing a second connector to the second end of the electrical cable, wherein the second connector is welded or brazed to the internal core section by welding or brazing a cladding layer to an internal connector pin, and the outer sheath section of the second end of the first electrical cable to provide an electrical connection between the magnetic bearing and the external connector.

2. The method of claim 1, further comprising:

welding or brazing a third connector to a first end of a second electrical cable, wherein the third connector is welded or brazed to an internal core section by welding or brazing a cladding layer to an internal connector pin, and to an outer sheath section of the first end of the second electrical cable; and welding or brazing a fourth connector to a second end of the second electrical cable, wherein the fourth connector is welded or brazed to the internal core section by welding or brazing the cladding layer to an internal connector pin, and to the outer sheath section of the second end of the second electrical cable.

3. The method of claim 2, further comprising:

connecting the first connector to a first magnetic bearing;

connecting the second connector to a first external connection;

connecting the third connector to a second magnetic bearing;

connecting the fourth connector to a second external connection;

wherein the first connector to the internal core section is located closer to the first magnetic bearing than a location for welding or brazing the first connector to the outer sheath section; and wherein the second connector to the internal core section which is located closer to the first external connection than a second location for welding or brazing the second connector to the outer sheath section.

* * * * *